US006074235A

United States Patent [19]

Brandberg et al.

[11] Patent Number: 6,074,235

[45] Date of Patent: Jun. 13, 2000

[54] ALIGNMENT POST HAVING AN IMPROVED LOCKING FEATURE

[75] Inventors: Philip C. Brandberg, Carlisle; Lou Castagna, Middletown; John A. Fulponi, Harrisburg; Greg G. Griffith, Carlisle; Hung T. Nguyen, Harrisburg, all of Pa.

[73] Assignee: The Whitaker Corporation, Wilmington, Del.

[21] Appl. No.: 09/264,976

[22] Filed: Mar. 9, 1999

Related U.S. Application Data

[60] Provisional application No. 60/080,908, Apr. 7, 1998.

[51] Int. Cl.[7] ..... H01R 13/64

[52] U.S. Cl. ..... 439/378

[58] Field of Search ..... 439/378–381, 439/357, 358

[56] References Cited

U.S. PATENT DOCUMENTS

| | | | |
|---|---|---|---|
| 4,980,800 | 12/1990 | Furuta | 439/378 |
| 5,007,858 | 4/1991 | Daly et al. | 439/498 |
| 5,162,000 | 11/1992 | Frantz | 439/607 |
| 5,197,900 | 3/1993 | Ellis et al. | 439/352 |
| 5,266,047 | 11/1993 | Black et al. | 439/364 |
| 5,342,216 | 8/1994 | Davis et al. | 439/362 |
| 5,647,758 | 7/1997 | Ichikawa et al. | 439/362 |
| 5,795,177 | 8/1998 | Hirono | 439/378 |

FOREIGN PATENT DOCUMENTS

| | | | |
|---|---|---|---|
| 275762 | 1/1990 | Germany | 439/378 |
| 1064319 | 12/1983 | U.S.S.R. | 439/378 |

*Primary Examiner*—Gary F. Paumen

[57] ABSTRACT

The invention is directed to an electrical connector (20) having a housing with electrical contacts secured therein. An alignment post (30') is secured to the housing. The alignment post (30') has a forward end (131) with a first width, a locking groove (32'), and a flared portion (130) disposed between the forward end (131) and the locking groove (32'). The flared portion (130) has a second width that is greater than the width of the forward end (131). The flared portion (130) defines a locking shoulder (132).

5 Claims, 6 Drawing Sheets

ALIGNMENT POST HAVING AN IMPROVED LOCKING FEATURE

This application claims benefit of Provisional Appl. No. 60/080,908 filed Apr. 7, 1998.

FIELD OF THE INVENTION

The invention is directed to an alignment feature to ensure that mating electrical connectors are properly aligned during the mating and unmating process. A further feature of the invention is to ensure that the proper electrical contacts are connected first during mating thereby providing the electrical connector with make first break last capability.

BACKGROUND OF THE INVENTION

When electrical connectors are mated with each other, the respective contacts are brought into physical as well as electrical contact with each other. Many of the contacts are delicate and can easily be damaged during the mating process. If the mating electrical connectors are not properly aligned with each other during this process, contacts can stub on each other or can otherwise damage themselves.

In some systems, it is advantageous for one electrical contact to make an electrical connection with its mating contact first, before any other contacts touch. It can also be advantageous for one contact to be the last to break electrical connection. This process is known as "Make First, Break Last". This form of mating is especially important where connectors will be hot plugged, or connected to electrical systems that are already electrically charged. If the electrical connectors are not properly aligned, it is possible for the wrong contacts to become electrically connected first thereby damaging the electrical system.

What is needed is an improved alignment feature that ensures that the connectors and the contacts are properly aligned during the mating process.

What is also needed is an alignment member that provides secure locking between the mated connectors

SUMMARY OF THE INVENTION

The invention is directed to an electrical connector having a housing with electrical contacts secured therein. An alignment post is secured to the housing. The alignment post has a forward end with a width, a locking groove, and a flared portion disposed between the forward end and the locking groove. The flared portion has a second width that is greater than the width of the forward end. The flared portion defines a locking shoulder.

BRIEF DESCRIPTION OF THE DRAWINGS

The invention will now be described with reference to the accompanying drawings, in which.

DETAILED DESCRIPTION OF EMBODIMENTS OF THE INVENTION

Figure 1:
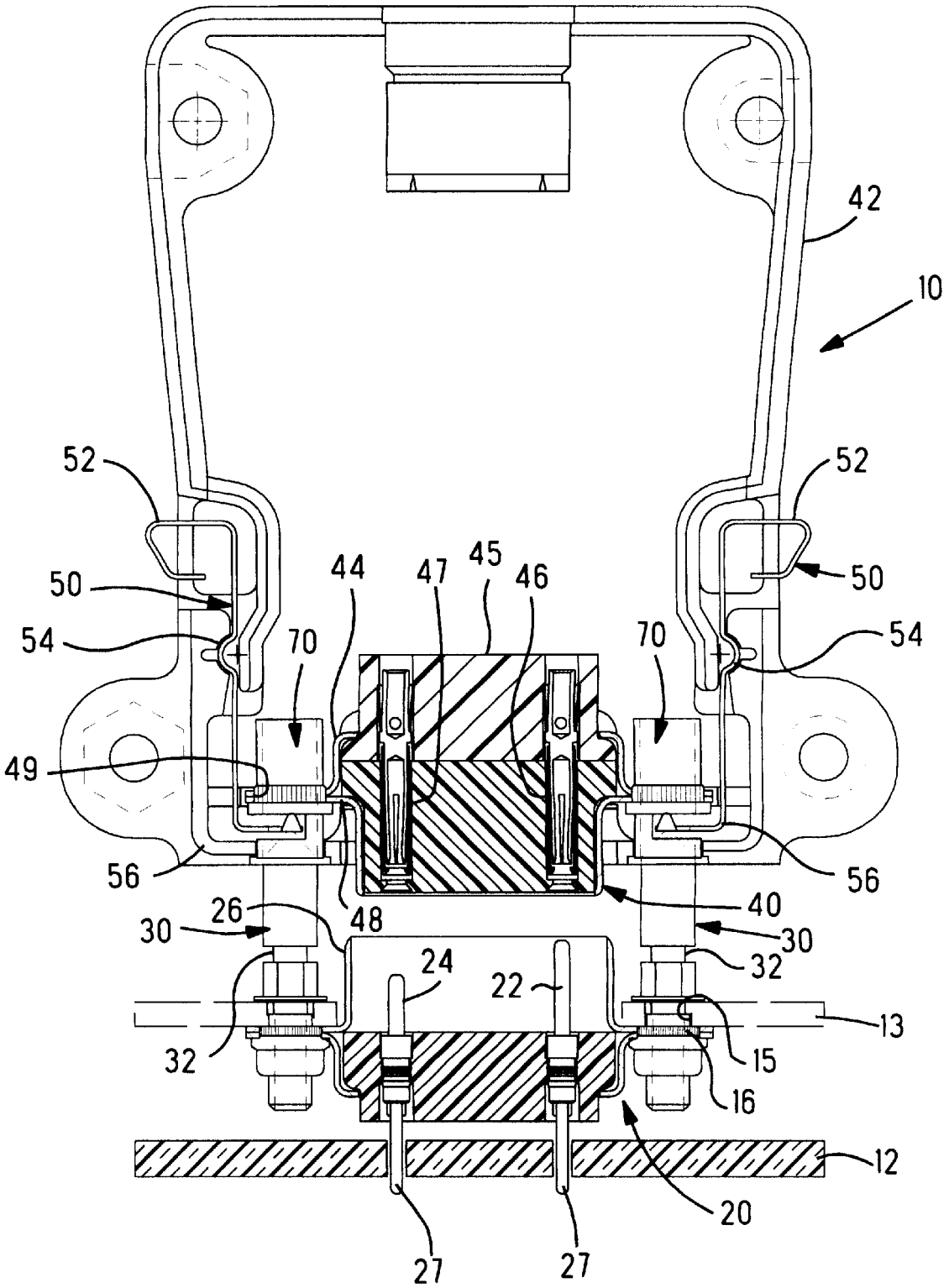
FIG. 1 is a cross-sectional view of two mating electrical connectors.

FIG. 1 is a partial cross-sectional view of an electrical connector 10 that is being mated with a second electrical connector 20. The second electrical connector 20 is secured to a circuit board 12.

The electrical connector 20 has contact pins 22, 24, and an outer shell 26. The contact pins 22, 24 are secured to the circuit board 12 by tails 27. The electrical connector 20 is secured to a panel 13 by way of alignment posts 30 that extend through holes in the panel 13. The aligning posts 30 also extend through holes 15 in flanges 16 on the shell 26. One of the contact pins 22 is longer than the other contact pin 24. During mating, electrical connection will occur with the longer contact pin 22 first. Electrical connector 20 is shown with only two contact pins, however, it is to be understood that the electrical connector can have any number of pins depending on the specific requirements of the system.

The alignment post 30 is used both to secure the connector 20 to the panel 13 and to serve as an aligning member for the electrical connector 20.

The mating electrical connector 10 includes a shielded electrical connector 40, such as a D-sub connector, which is secured within a back shell 42. The electrical connector 40 has an outer shell 44, housing 45 and contacts 46, 47. The contacts 46, 47 will be terminated to cables, not shown. The outer shell 44 forms a flange 48 on either side of the electrical connector 40. The flanges 48 have holes 49 therein.

The backshell 42 encloses a portion of the connector 40 and is typically formed from two halves, only one of which is shown, and has a latching mechanism that comprises two locking arms 50 along either side that are secured within the backshell 42. The backshell 42 can take on various arrangements other than the one shown and described herein. The locking arms 50 have an actuation end 52 that extends outside of the backshell 42 and can be depressed by the operator. The locking arms 50 also have a pivot point 54 where it is secured within the backshell and a latching or locking end 56. When the actuation ends 52 are depressed inwardly, the locking ends 56 will be rotated outwardly to permit an alignment member or bushing 70 to receive the locking post 30.

Figure 2:
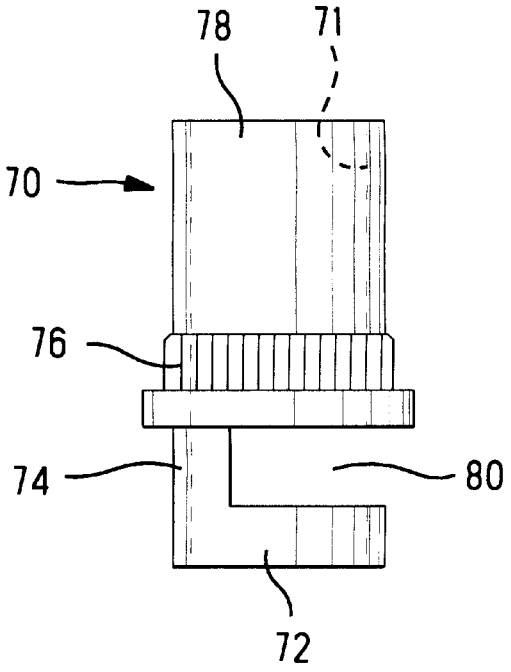
FIG. 2 is a side view of a bushing that is to serve as the alignment member.
Figure 3:
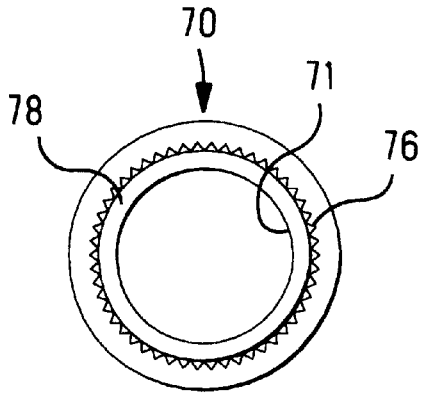
FIG. 3 is an end view of the bushing.

The electrical connector 10 also includes alignment members or bushings 70. The bushings 70 are press fit into the holes in the flanges 48 to be secured therein. The bushing 70 is further shown in FIGS. 2 and 3. The bushing 70 is a cyclindrical member having a hollow interior, defining an axially extending opening 71 as shown in FIG. 3, through which the alignment post 30 is received. Bushings 70 have a length selected to extend along a sufficiently long enough portion of corresponding posts 30 such that connector 20 does not tip out of alignment during the mating process. Axially extending opening 71 is configured to receive at least the forward portion 31 of alignment post 30. Along the forward end of the bushing 70 is forward arm 72 that is attached to the main portion of the housing by extender 74. Along the center portion of the bushing 70 is a knurled section 76 that is pressed into the opening 49 on the flange 48. Along the rear portion of the bushing 70 is cylindrical section 78 with a hollow interior through which the alignment post will extend. Between the arm 72 and the knurled section 76 there is an opening 80 extending into alignment member 70 in a direction orthogonal to axial opening 71. The forward arm 72 provides a alignment element that is forward of the flange 48 and the cylindrical section 78 provides a rearward aligning feature that is rearward of the flange 48. The opening 80 will allow locking to the alignment post as will be described hereinafter.

Figure 4:
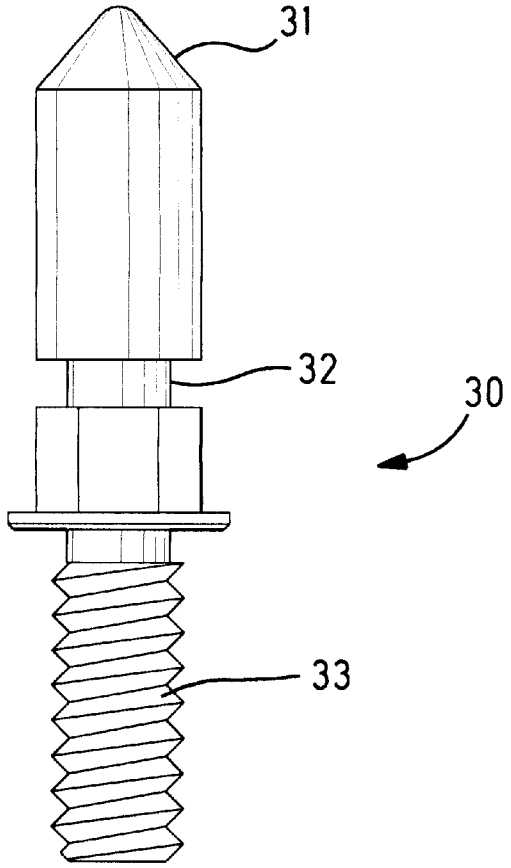
FIG. 4 is a side view of the alignment post.

The alignment post 30 is shown in FIGS. 1 and 4. The alignment post 30 has a tapered end 31 to allow ease of mating with the bushing 70 on the electrical connector 10. Furthermore, the alignment post 30 has grooves 32 and an extension 33 that will extend through panel 13 and be used to secure the electrical connector 20 to panel 13.

Figure 5:
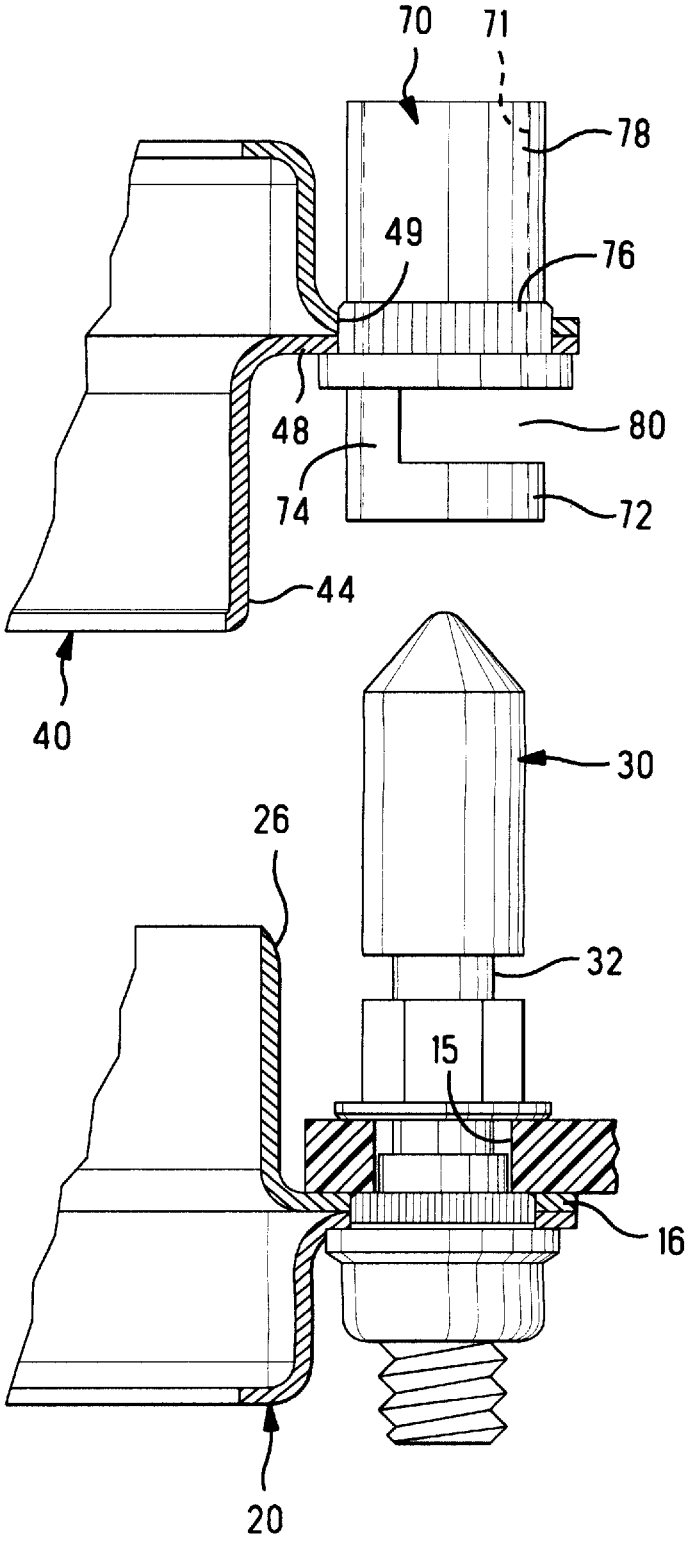
FIG. 5 is a cross-sectional view of a fragmentary portion of the electrical connectors during the mating process.

FIG. 5 shows an enlarged view of the alignment post 30 and the alignment bushing 70 just prior to mating of the electrical connectors 10, 20. For simplicity, the backshell 42 and the locking arm 50 have not been shown in order to show the interaction between the alignment post 30 and the alignment bushing 70. As the electrical connectors 10, 20 are mated, the alignment posts 30 are received in the forward arms 72 of the bushings 70. The inner diameter of the bushing 70 and the outer diameter of the alignment post 30 are very tightly matched so that the post is fit securely within the alignment bushing. This tight fit minimizes the tilt between the electrical connectors 10, 20 about a central line during mating and unmating of the electrical connectors. As mating continues, the alignment posts 30 will enter the cylindrical sections 78. The interaction between the alignment posts 30 and the cylindrical sections 78 ensures that the electrical connectors 10, 20 remain properly aligned with each other during the full course of mating the two connectors.

When the electrical connectors 10, 20 are fully mated, the opening 80 and the locking groove 32 are aligned with each other. At this point, the locking end 56 of locking arm 50 will move through the opening 80 and into the locking groove 32 thereby securing the electrical connector 10 to the alignment post 30 and securing the electrical connectors 10, 20 together. Posts 30, therefore, define locking posts as well as alignment posts.

Referring again to FIG. 1, the alignment posts 30 extend beyond the mating face of the electrical connector 20. Therefore, when the alignment posts 30 engage the bushings 70 the contacts 22, 46 and 24, 47 in the electrical connectors 10, 20 have not yet come into contact. As they are brought together, the electrical connectors 10, 20 are kept in proper alignment with each due to the tight tolerances between the bushing 70 and the alignment post 30. This ensures that electrical contact pin 22 is first connected with its mating contact 46 prior to the pin 24 making electrical contact with its corresponding contact 47.

Figure 6:
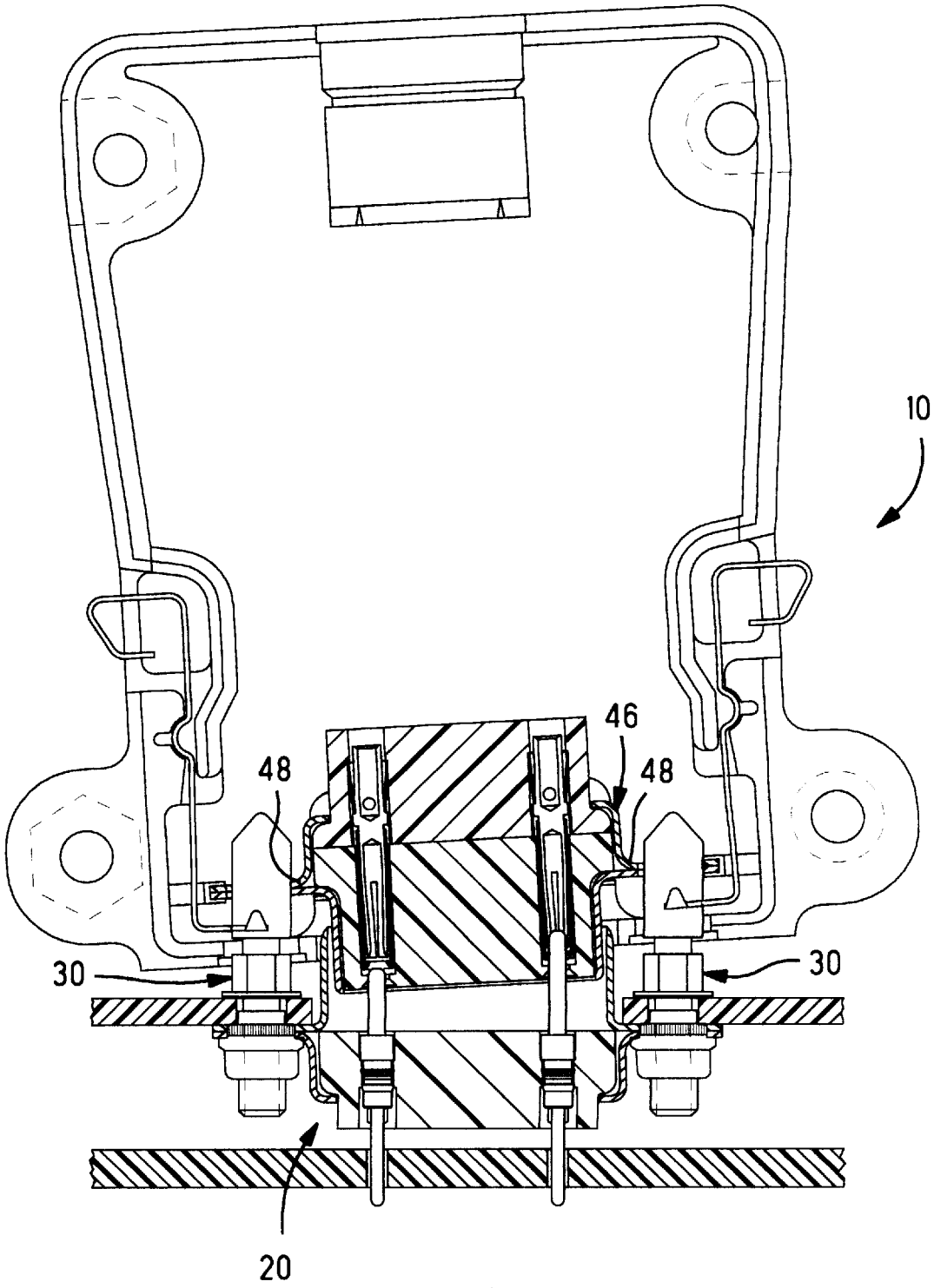
FIG. 6 is a cross-sectional view of mating connectors that are not properly aligned.

In the absence of such an alignment feature, it is possible that electrical connector 10 could approach electrical connector 20 at an angle sufficient for contact 47 to come into contact with pin 24 prior to, or at the same time as, contact 46 comes into electrical contact with pin 22. This could cause failure in the electrical system if the connector is being hot plugged. FIG. 6 shows electrical connector 20 without alignment bushings 70. This view shows that it is possible to tilt electrical connector 20 from the centerline of the electrical connector 10. This tilt can cause problems when the corresponding contacts are brought together close enough so that they can touch and it may be possible for the wrong contacts to touch first or at the same time as the proper contacts.

Without the alignment post 30 and the bushing 70, it is possible for the D-sub connectors to be improperly oriented with respect to each other. When the improperly oriented connectors are brought together, it is possible to tilt one or the other enough to allow the wrong contacts to touch. With the alignment post and bushing, the connectors are not allowed to tilt and it would be difficult to improperly mate the connectors in the wrong orientation or override the contact sequencing.

Figure 7:
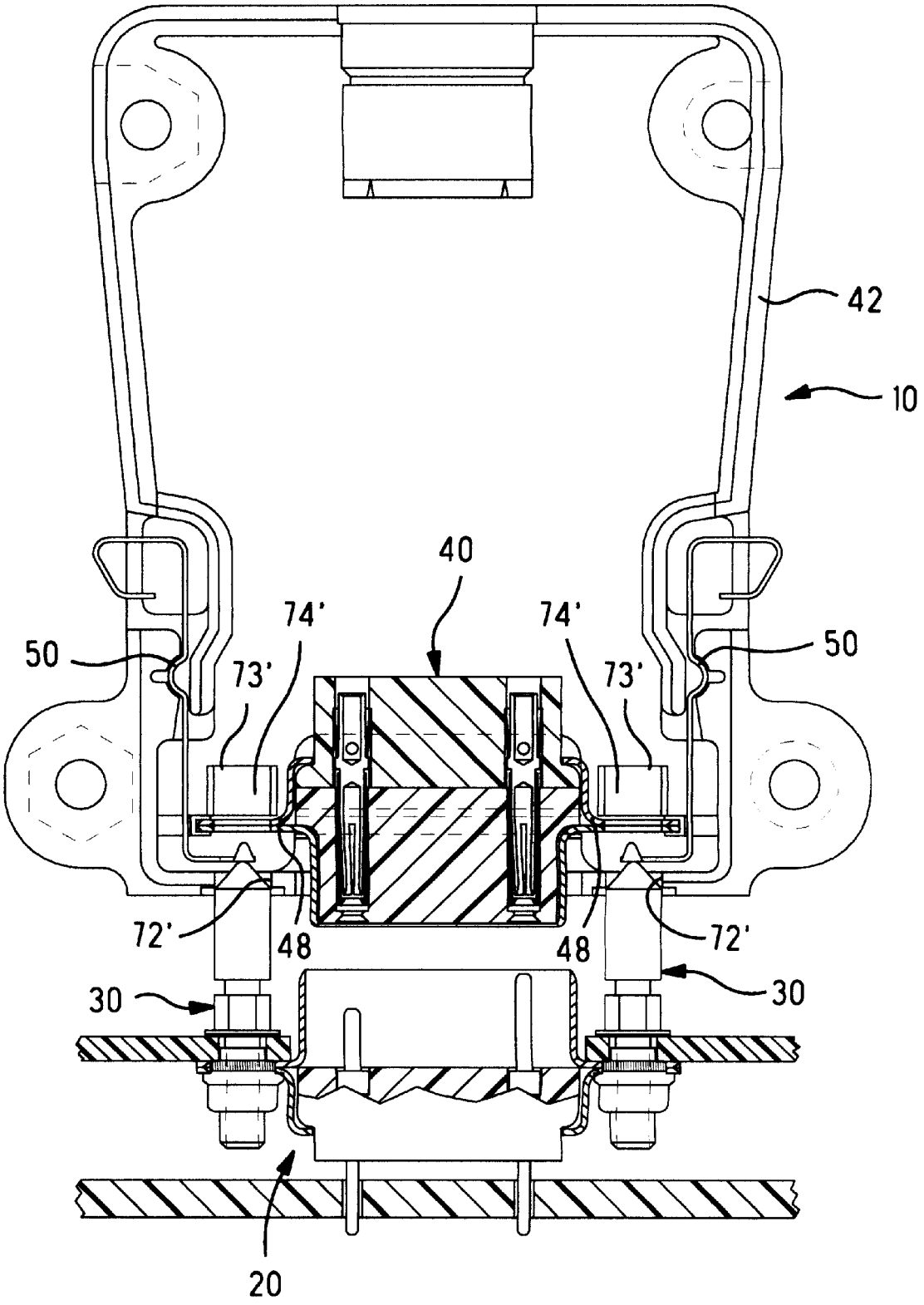
FIG. 7 is a partial cross-sectional view of an alternative embodiment of the present invention.

An alternative embodiment of the present invention will now be described with reference to FIG. 7, in which like features will have the same reference numeral. FIG. 7 shows an electrical connector 10 wherein the alignment feature is built into the backshell 42. The backshell 42 has a forward alignment feature, which is forward of the flange 48 on the electrical connector 40. The forward alignment feature is a semicircular opening 72' that is disposed on each half of the backshell 42. The rearward alignment feature is a projection 73' that extends from the backshell 42 and forms a semicircular shelf 74' on each half of the backshell. When the two halves of the backshell 42 are assembled, the semicircular opening 72' forms a circular opening that is aligned with the alignment post 30 and the semicircular shelves 74' form a second circular opening that is aligned with the first circular opening and provides the rearward alignment feature. The flange 48 of the connector 40 is received between the semicircular openings 72' and the semicircular shelves 74' and the latching end 56 of the locking arm 70 is received in front of the flange 48, between the semicircular opening 72' and the semicircular shelf 74'.

The tilting of the electrical connector in the present invention is minimized by the alignment bushing. This ensures that the connector has make first break last capability and it minimizes or reduces contact stubbing.

Figure 8:
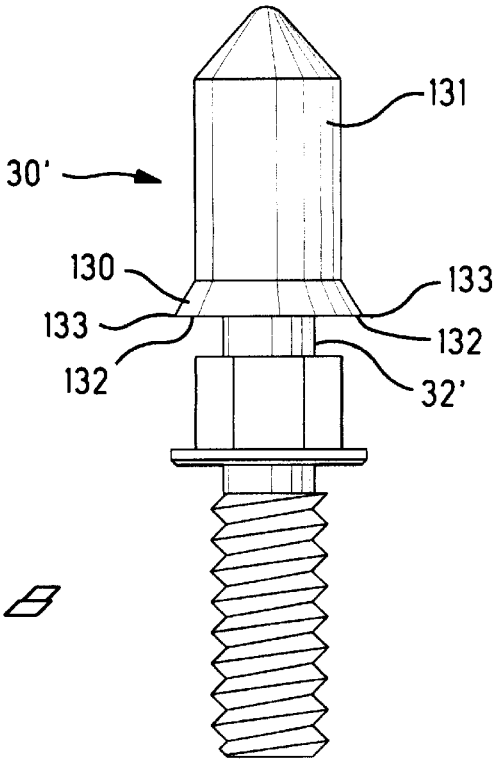
FIG. 8 is a side view of an alternative embodiment of the locking post.

FIG. 8 shows an alternative embodiment of the alignment and locking post. Alignment post 30' will be used in the same manner as was previously described for alignment and locking post 30. Post 30' will be used as an alignment post between electrical connector 10 and electrical connector 20 and also as a locking post to secure the electrical connectors 10, 20 together. In the same manner, alignment post 30' would be mounted on either side of electrical connector 20. Post 30' has a forward end 131, a flared portion 130, a locking groove 32', and a locking shoulder 132.

One difference between the alignment post 30' as shown in FIG. 8 and the alignment post 30 as shown in FIG. 4, is that the width of the forward end 131 is less than the width of the forward end 31 of alignment post 30. The smaller width allows the electrical connector 20 to be mated with a greater variety of mating connectors 10 having smaller boles in which the alignment post 30' will be inserted.

A further difference is that alignment post 30' has flared portion 130 and locking shoulder 132. The flared portion 130 has angled surfaces that are angled outwardly from the forward end 131 to the edge 133. The edge 133 has a wider width than the forward end 131. The locking shoulder 132 is adjacent to the edge 133 and the locking shoulder 132 forms the forward side of the locking groove 132'.

The locking shoulder 132 forms a locking surface that extends from the outer diameter of the locking groove 32' to the outer edge 133 of the flared portion 130. The locking surface of the locking shoulder 132 is larger than if the locking surface just extended as far as the outer diameter of the forward end 131. The larger surface provides a better surface with which to engage the locking ends 56 of latching arm 50 on the connector 10.

An advantage of having the flared portion 130 is that the forward end 131 of the alignment post 30' can be made smaller without loosing the ability to provide a good locking surface to secure the connectors together. This allows the connector 20 to be mated with a larger variety of mating connectors 10 because the forward end 131 of locking post 30' is smaller and can be received in a greater variety of sizes of alignment holes in the mating connector 10.

Figure 9:
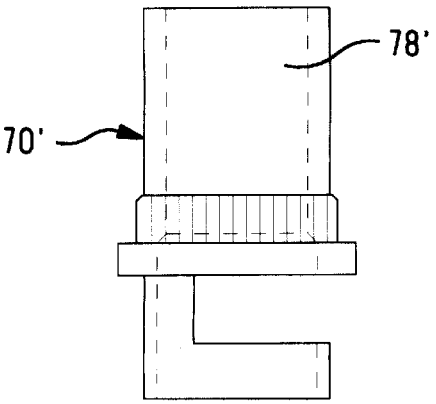
FIG. 9 is a side view of an alternative embodiment of the bushing.
Figure 10:
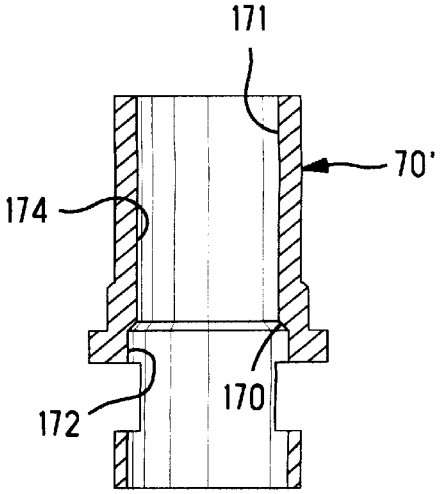
FIG. 10 is a cross-sectional view of the bushing of FIG. 9.

In order to provide the best alignment between connectors 20 and 10, alignment bushing 70' as shown in FIG. 9 can be installed in electrical connector 10. Bushing 70' is essentially similar to that shown in FIG. 2 with the exception that within the axially extending opening 171 of bushing 70', there is step down portion 170 that goes from a larger inner diameter 172 to a narrower inner diameter 174 along the end 78'. The step down portion 170 provides clearance to snugly receive the flared portion 130 of the alignment post 30' within the bushing 70'. The bushing 70' has tight tolerances to provide a close fit between the bushing 70' and the alignment post 30'. In this case using the alignment post 30', as shown in FIG. 8, along with the alignment bushing 70', as shown in FIGS. 9 and 10, provides electrical connector 20 with the ability to provide high alignment with electrical connector 10.

In addition, electrical connector 20 can also be mated with other electrical connectors that do not have the alignment bushing and have varying sizes of alignment holes. While this may not provide the high alignment, it still allows compatibility of electrical connector 20 with other mating electrical connectors.

The electrical connector, and the alignment and locking post of the present invention and many of the attendant advantages will be understood from the foregoing description. It is apparent that various changes may be made in the form, construction, and arrangement of parts thereof without departing from the spirit or scope of the invention or sacrificing all of its material advantages.

What is claimed is:

1. An electrical connector, comprising:

a housing having electrical contacts secured therein;

an alignment post secured to said housing and extending forwardly from a mating face thereof, said alignment post having a forward end with a first width, a locking groove, and a flared portion disposed between said forward end and said locking groove, said flared portion having a second width that is greater than said first width, said flared portion having a locking shoulder;

whereby upon mating said connector to a complementary mating connector having an alignment opening therein adapted to receive said alignment post, said forward end of said alignment post is received in said alignment opening to align said connector and said complementary connector prior to electrical engagement of respective complementary contacts and upon full mating, said locking shoulder is positioned to be engaged by a latching member of said complementary mating connector.

2. An electrical connector assembly comprising:

a first connector having a housing with electrical contacts secured therein, said housing having a mating face and a pair of alignment posts extending forwardly from said mating face, said alignment post having a forward end with a first width, a locking groove, and a flared portion disposed between said forward end and said locking groove, said flared portion having a second width that is greater than said first width, said flared portion having a locking shoulder; and a second connector complementary to said first connector and matable thereto, said second connector including a housing having electrical contacts secured therein and complementary to said contacts of said first connector, said housing including a latching arm for securing said first and second connectors together upon full mating thereof and a pair of alignment openings adapted to receive said alignment posts of said first connector during and after mating of said first and second connectors, such that upon full mating said locking shoulders are in position for engagement by locking ends of said latching arms to secure said first and second connectors together.

3. The connector assembly of claim 2 wherein said alignment openings of said second connector extend axially through alignment members having a selected axial length and adapted to extend along a portion of said alignment posts thereby essentially preventing said first and second connectors from tilting out of alignment during mating.

4. The connector assembly of claim 3 wherein said alignment opening in each said alignment member is configured to closely receive said alignment post.

5. An electrical connector including a housing having a housing having a pair of alignment posts secured to said housing and extending forwardly from a mating face thereof, each said alignment post having a forward end with a first width, and a locking groove adapted to receive a latching member of a mating connector, said connector being characterized in that:

each said alignment post includes a flared portion disposed between said forward end and said locking groove, said flared portion having a second width that is greater than said first width, said flared portion having a locking shoulder;

whereby upon mating said connector to a complementary mating connector having an alignment opening therein adapted to receive said alignment post, said forward end of said alignment post is received in said alignment opening to align said connector and said complementary connector prior to electrical engagement of respective complementary contacts and upon full mating, said locking shoulder is positioned to be engaged by a latching member of said complementary mating connector.

* * * * *